US006622613B1

(12) United States Patent
Kortas et al.

(10) Patent No.: US 6,622,613 B1
(45) Date of Patent: Sep. 23, 2003

(54) MULTIPIECE PISTON

(75) Inventors: Jochen Kortas, Stuttgart (DE); Stefan Lipp, Neuhausen (DE); Wilfried Sander, Neckarsulm (DE)

(73) Assignee: Mahle GmbH, Stuttgart (DE)

( * ) Notice: Subject to any disclaimer, the term of this patent is extended or adjusted under 35 U.S.C. 154(b) by 0 days.

(21) Appl. No.: 09/914,973

(22) PCT Filed: Jan. 25, 2000

(86) PCT No.: PCT/DE00/00199

§ 371 (c)(1),
(2), (4) Date: Sep. 6, 2001

(87) PCT Pub. No.: WO00/53913

PCT Pub. Date: Sep. 14, 2000

(30) Foreign Application Priority Data

Mar. 10, 1999 (DE) ..... 199 10 582

(51) Int. Cl.[7] ..... F01B 31/08
(52) U.S. Cl. ..... 92/223; 92/224
(58) Field of Search ..... 92/220, 222, 223, 92/224, 225, 226, 227, 228, 229, 230

(56) References Cited

U.S. PATENT DOCUMENTS 4,083,292 A * 4/1978 Goloff ..... 92/220
5,136,992 A 8/1992 Bregler et al.
5,724,933 A * 3/1998 Silvonen et al. ..... 92/220
5,817,196 A 10/1998 Teracher et al.

FOREIGN PATENT DOCUMENTS

| | | |
|---|---|---|
| DE | 29 19 638 | 11/1980 |
| DE | 84 21 300 | 4/1988 |
| DE | 41 12 576 | 10/1991 |
| DE | 40 24 381 | 2/1992 |
| DE | 41 29 746 | 4/1994 |
| DE | 43 22 786 | 1/1995 |
| DE | 44 16 120 | 11/1995 |
| DE | 44 29 489 | 2/1996 |
| DE | 197 21 013 | 12/1998 |
| EP | 0 731 268 | 9/1996 |

* cited by examiner

*Primary Examiner*—Edward K. Look
*Assistant Examiner*—Igor Kershteyn
(74) *Attorney, Agent, or Firm*—Collard & Roe, P.C.

(57) ABSTRACT

A multipiece piston comprises a steel upper part and a lower part which is screwed to the upper part and which contains the hubs. The design of the piston improves the strength of the lower part and its resistance to material defects, and reduces production cost. The lower part of the piston consists of a precipitation-hardened ferrite-pearlite steel, preferably according to EN 10267 and with added titanium. The hubs of the lower part are preferably not reinforced with bushings.

9 Claims, 1 Drawing Sheet

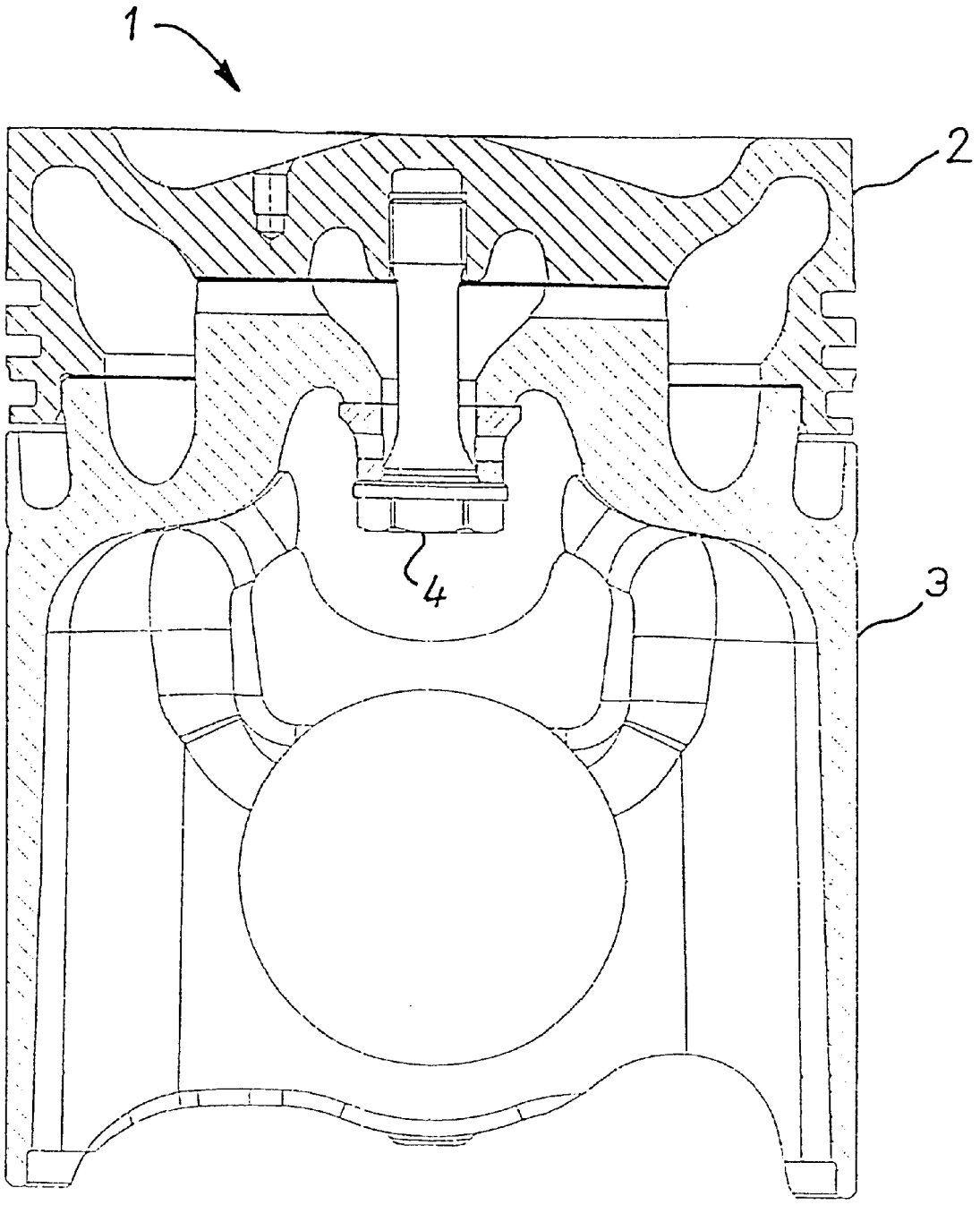
1
2
3
4

MULTIPIECE PISTON

CROSS REFERENCE TO RELATED APPLICATIONS

Applicants claim priority under 35 USC 119 of German Application No. 199 10 582.0, filed on Mar. 10, 1999. Applicants also claim priority under 35 USC 165 of PCT/DE00/00199, filed on Jan. 25, 2000. The international application under PCT article 21(2) was not published in English.

BACKGROUND OF THE INVENTION

1. Field of the Invention

The invention concerns multipiece pistons.

2. The Prior Art

A piston of this type can be inferred from the abstract of DE-A-44 16 120 as a possible implementation. Lower parts made of steel have, however, been viewed by those skilled in the art as impractical for reasons of production up until now, particularly for pistons with larger diameters.

Multipiece pistons know from practice, in which a lower part is screwed onto an upper part in a method according to this type, typically have lower parts made of pressed aluminum or cast iron. It has been shown that the known lower parts are increasingly reaching the limits of their strength and that, particularly for lower parts make fo cast iron, these limits are caused by casting defects which, in spite of increased expenditures for testing, can hardly be prevented.

SUMMARY OF THE INVENTION

The invention therefore concerns itself with the problem of preparing a lower part for pistons of this type which meets the increased requirements for strength while simultaneously being economically producible.

Through the production of the lower part using forging technology in connection with the material precipitation-hardened, ferrite-pearlite steel, an economically producible lower part with high strength is provided.

Because the microstructure of the precipitation-hardened ferrite-pearlite steel is achieved through appropriate heat control during the forging process, in larger components with corresponding wall thicknesses—the lower parts of multipiece pistons of greater than 250 mm in diameter are included in these—the danger arises that the desired microstructure will not be achieved over the entire cross section, and the strength will turn out to be lower than expected.

Titanium can be added to the precipitation-hardened, ferrite-pearlite steel as a means to achieve the desired microstructure—particularly in regard to the grain size. The steel 38 MnVs6 has been shown to be an advantageous precipitation-hardened ferrite-pearlite steel.

The use of bushings in the region of the hubs can be dispensed with if the piston pins and/or the pin hubs are coated. Phosphatizing is particularly considered in this regard.

In addition, through the material of the lower part according to the invention, it is also possible to increase the surface pressures n the region of the pins.

The lower length of the multipiece piston is advantageously reduced to less than 40% of the piston diameter, because in this way weight is saved and forging technology problems are avoided. Nonetheless, due to the higher module of elasticity of steel compared to gray cast iron and aluminum, a uniform straight-line motion is achieved.

One or more recesses to receive the cooling oil are introduced into the bottom of the lower part by machining.

The diameter range for lower parts according to the invention begins at approximately 160 mm. Conditioned by the icreased material strength, the wall thickness can—compared with cast lower parts—be lower locally. In any case, higher wall thicknesses are also achieved in some parts through the taper bevels necessary for forging.

BRIEF DESCRIPTION OF THE DRAWINGS

In the following, the invention will be described more in detail with reference to an exemplary embodiment.

FIG. 1 shows a multipiece piston according to the invention in cross-section in the DR-GDR direction.

DETAILED DESCRIPTION OF THE PREFERRED EMBODIMENT

A multipiece piston 1 consists of an upper part 2 made of forged steel, which is connected with a lower part 3 made of forged precipitation-hardened ferrite-pearlite steel with a centrally located screw 4. The lower part is implemented without bushings.

The lower length of the lower part is less than 40% of the piston diameter.

Because upper part 2 and the lower part 3 are hatched in the same direction, the partition line between the two is emphasized by a greater line thickness

What is claimed is:

1. A multipiece piston with an upper part made of steel and a lower part screwed to the upper part, said lower part containing hubs and a material different from the upper part, wherein the lower part consists of precipitation-hardened, ferrite-pearlite steel (AFP steel) and is extruded or forged.

2. The multipiece piston according to claim 1, where in the material of the lower part is a precipitation-hardened, ferrite-pearlite steel according to steel-iron data sheet EN 10267.

3. The multipiece piston according to claim 1, wherein the precipitation-hardened, ferrite-pearlite steel also has a titanium content of 0.01–0.05 weight percent.

4. The multipiece piston according to claim 1, wherein the hubs of the piston are not reinforced with bushings and pins and/or hub borings of the piston are coated.

5. The multipiece piston according to claim 4, wherein the hub borings and/or the pins of the piston are phosphatized.

6. The multipiece piston according to claim 1, wherein the maximum surface pressure occuring in the hubs is >85 n/mm.

7. The multipiece piston according to claim 1, wherein the lower part has at least one recess in a region neighboring the upper part for receiving cooling oil, said at least one recess being produced through machining.

8. The multipiece piston according to claim 1, wherein a diameter of the lower part measures at least 160 mm.

9. The multipiece piston according to claim 1, wherein a diameter of the lower part measures at least 250 mm.

* * * * *